US009532650B2

(12) United States Patent
Barnett

(10) Patent No.: US 9,532,650 B2
(45) Date of Patent: Jan. 3, 2017

(54) OUTRIGGER STABILIZER

(71) Applicant: Ralph Lipsey Barnett, Wilmette (IL)

(72) Inventor: Ralph Lipsey Barnett, Wilmette (IL)

( * ) Notice: Subject to any disclaimer, the term of this patent is extended or adjusted under 35 U.S.C. 154(b) by 51 days.

(21) Appl. No.: 14/480,194

(22) Filed: Sep. 8, 2014

(65) Prior Publication Data

US 2015/0130339 A1 May 14, 2015

Related U.S. Application Data

(60) Provisional application No. 61/874,517, filed on Sep. 6, 2013.

(51) Int. Cl.
*A47B 97/00* (2006.01)
*A47B 63/00* (2006.01)

(52) U.S. Cl.
CPC ..... *A47B 97/00* (2013.01); *A47B 63/00* (2013.01); *A47B 2097/008* (2013.01)

(58) Field of Classification Search
CPC ... A47B 2097/008; A47B 97/00; A47B 91/00; A47B 91/02; A47B 91/16; A47B 63/00; E05B 65/463; A47L 15/4253; A47L 15/427; F24C 15/083
USPC ..... 312/351.1, 351.3, 351.7, 351.2,312/351.4–351.9, 351.13, 351.14; 248/681, 188.8, 500, 680, 188.1, 248/346.03, 346.05, 351, 903
See application file for complete search history.

(56) References Cited

U.S. PATENT DOCUMENTS 2,176,255 A * 10/1939 Frost ..... A47B 91/16 248/188.3
2,795,892 A * 6/1957 Lautenbacher ..... A47B 91/16 16/44
2,907,598 A * 10/1959 Hart ..... A47B 91/02 248/354.1
3,572,621 A * 3/1971 Whitten ..... F16F 15/067 248/548
4,372,632 A * 2/1983 Villa ..... E05B 65/463 312/107.5
4,842,236 A * 6/1989 Yonts ..... B60P 7/0823 248/499
4,942,942 A * 7/1990 Bradley ..... A45F 3/26 108/152
5,131,617 A * 7/1992 McGarrah ..... G07F 9/10 248/500
5,156,451 A * 10/1992 Pollock ..... G07F 9/10 248/616
5,192,123 A * 3/1993 Wallin ..... A47B 96/00 248/500
5,490,648 A * 2/1996 Cullen ..... A47B 91/02 248/188.3
6,119,989 A * 9/2000 Hollington ..... A47B 13/02 248/170
6,202,971 B1 * 3/2001 Duncan ..... B62J 1/08 248/407
8,118,379 B2 * 2/2012 Hong ..... D06F 39/125 248/188.3

(Continued)

*Primary Examiner* — Daniel J Troy
*Assistant Examiner* — Hiwot Tefera
(74) *Attorney, Agent, or Firm* — Pauley Erickson & Rottis

(57) ABSTRACT

The present invention is a filing cabinet with an outrigger that increases a footprint of the file cabinet to prevent the file cabinet from tipping over. The outrigger is positioned in proximity to a bottom of the housing, the outrigger includes a bias element to move a cantilever structure from a retracted position to a deployed position when the file cabinet is tipped to a release angle.

16 Claims, 9 Drawing Sheets

(56) References Cited

U.S. PATENT DOCUMENTS

| | | | | |
|---|---|---|---|---|
| 8,152,253 | B2 * | 4/2012 | Yu | A47B 97/00 312/349 |
| 2005/0051685 | A1 * | 3/2005 | Wu | F16M 11/00 248/188.8 |
| 2005/0051697 | A1 * | 3/2005 | Lowenstein | A47B 97/00 248/680 |
| 2008/0087777 | A1 * | 4/2008 | Christian | A47B 91/00 248/188.8 |
| 2009/0251038 | A1 * | 10/2009 | Yu | A47B 97/00 312/351.1 |
| 2010/0039010 | A1 * | 2/2010 | Hong | D06F 39/125 312/351.3 |
| 2015/0130342 | A1 | 5/2015 | Barnett | |
| 2015/0132097 | A1 | 5/2015 | Barnett | |

* cited by examiner

OUTRIGGER STABILIZER

CROSS REFERENCE TO RELATED APPLICATION

This application claims the benefit of U.S. Provisional Patent Application Ser. No. 61/874,517, filed on 6 Sep. 2013. The Provisional patent application is hereby incorporated by reference herein in its entirety and is made a part hereof, including but not limited to those portions which specifically appear hereinafter.

BACKGROUND OF THE INVENTION

Field of the Invention

This invention is directed to an apparatus to prevent file cabinets, furniture and other large items from tipping over and possibly injuring individuals. More specifically, this invention is directed to an outrigger for a file cabinet that deploys when the file cabinet is tipped to prevent the file cabinet from tipping over.

Discussion of Related Art

Traditional file cabinets are inherently dangerous because the sliding of drawers changes a center of gravity of the entire cabinet and when the center of gravity is not over the footprint of the cabinet, the cabinet can easily tip over. This inherent danger can be increased under reasonably foreseeable circumstances including: overloading cabinets; pulling downward on extended drawers; pulling horizontally on open or closed drawer hardware or cabinet structure; getting ensnared on the cabinet structure while walking away from the unit; impacting or pushing forward on a backside of the cabinet by people or vehicles, such as forklifts; mounting cabinets on non-level surfaces; and impact from rapidly opening drawers against stops. Known methods of increasing the stability of the file cabinets include: bolting the cabinets to the floor and/or wall; adding counterweights; gang bolting cabinets side-to-side or back-to-back; locating the file cabinet beneath a shelf or other horizontal surface that blocks the cabinet's ability to tilt; and interlock systems that permit only one drawer to be open at a time. Bolting, ganging and under mounting work well to minimize tipping; however, these methods immobilize cabinets and inhibit relocation within an office. Counterweights and interlocks only provide modest improvement in overturning resistance and cannot be retrofit to traditional file cabinets that have multi-decade life spans.

SUMMARY OF THE INVENTION

A general object of the invention is to provide an outrigger to a file cabinet that enlarges a footprint of the file cabinet to prevent the cabinet from tipping over.

In a preferred embodiment of this invention, the file cabinet includes a housing with a plurality of drawers. The cabinet further includes the outrigger including a latch to maintain the outrigger in a retracted position, wherein the latch releases the outrigger to a deployed position when the file cabinet tips to a release angle. In a preferred embodiment, the outrigger comprises steel, aluminum or any other type of durable material that is capable of supporting, at least temporarily, a weight of the file cabinet to allow a person to avoid the tipping file cabinet. The outrigger may also comprise any cross-sectional shape including, but not limited to, a circular shape, a rectangular shape, an I-beam shape and a U-shape. The outrigger may be prismatic or tapered. In a preferred embodiment, the outrigger may be positioned, at least partially, within a sleeve which provides structural support when the outrigger is deployed and supporting the file cabinet. In a preferred embodiment, the outrigger extends as a telescope. However, other means of extending may be used including, but not limited to, a roller track and a scissor mechanism. In a preferred embodiment, the outrigger is biased to the deployed position with one of an extension spring, a compression spring, a gas spring, a pneumatic or hydraulic device and an electromagnetic device. In a preferred embodiment, the tip resistant file cabinet includes one of a lock, a dog and a detent to prevent retraction of the outrigger when the outrigger is in a deployed position. The file cabinet of this invention, may also include a leveling screw to keep the file cabinet level.

In another embodiment of this invention, a lowest drawer of the file cabinet may be used as the outrigger to prevent the file cabinet from tipping over. The lowest drawer must be able, at least temporarily, to support the weight of the file cabinet to prevent the file cabinet from tipping over. In this embodiment, an interlock system which prevents multiple drawers from deploying at the same time must be disabled, at least for the moment of deployment, for the drawer operating as the outrigger.

In a preferred embodiment, the outrigger may be padded or otherwise provide protection to persons standing near the file cabinet when the outrigger deploys.

BRIEF DESCRIPTION OF THE DRAWINGS

These and other objects and features of this invention will be better understood from the following detailed description taken in conjunction with the drawings, wherein.

DETAILED DESCRIPTION OF PREFERRED EMBODIMENTS

The present invention provides a file cabinet 20 with an outrigger 10 which can extend from the file cabinet 20 when the file cabinet 20 starts tipping to prevent the file cabinet 20 from tipping over and possibly causing injuries. In an alternative embodiment, the outrigger 10 of this invention may be used with any type of furniture, appliance or large object that may be prone to tipping over including, but not limited to, bookcases, televisions, and dressers.

Figure 1A:
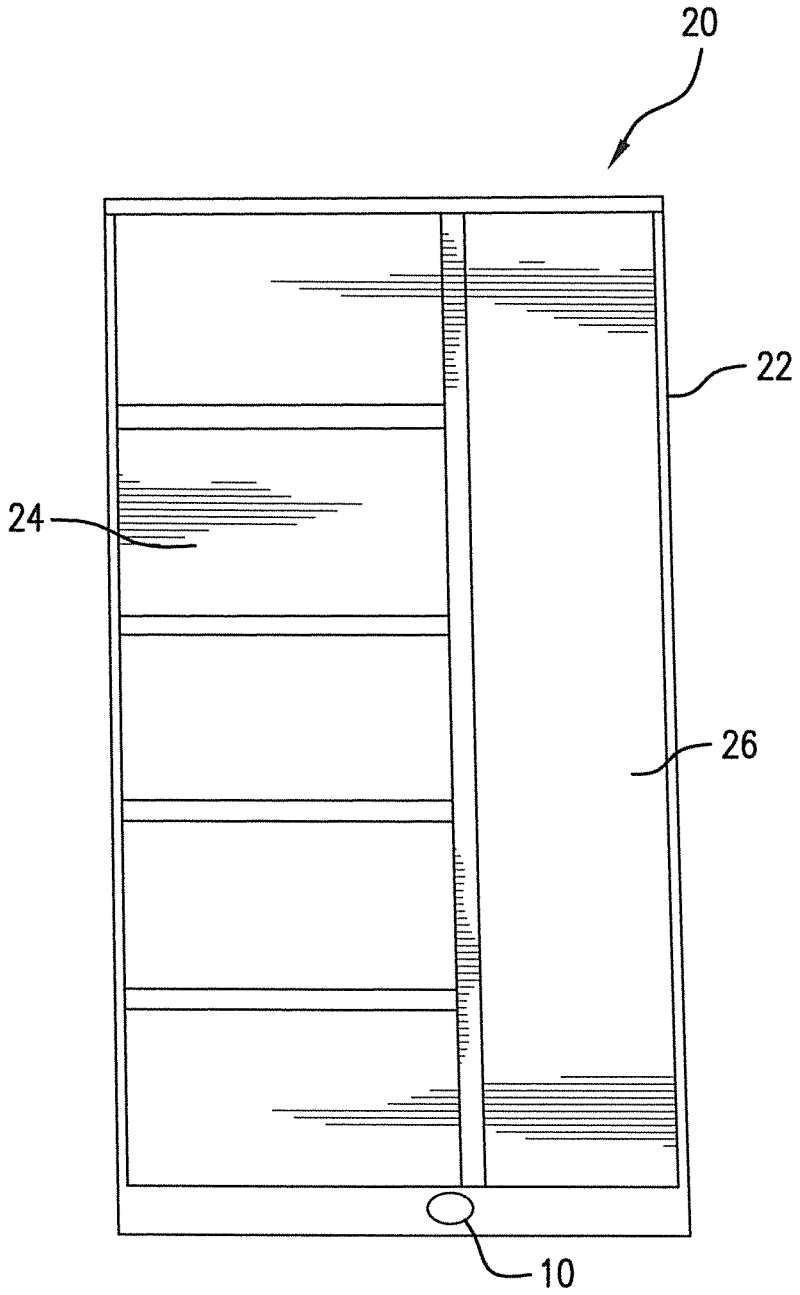
FIG. 1*a* is a front view of a file cabinet with an outrigger in a retracted position according to an embodiment of this invention.
Figure 1B:
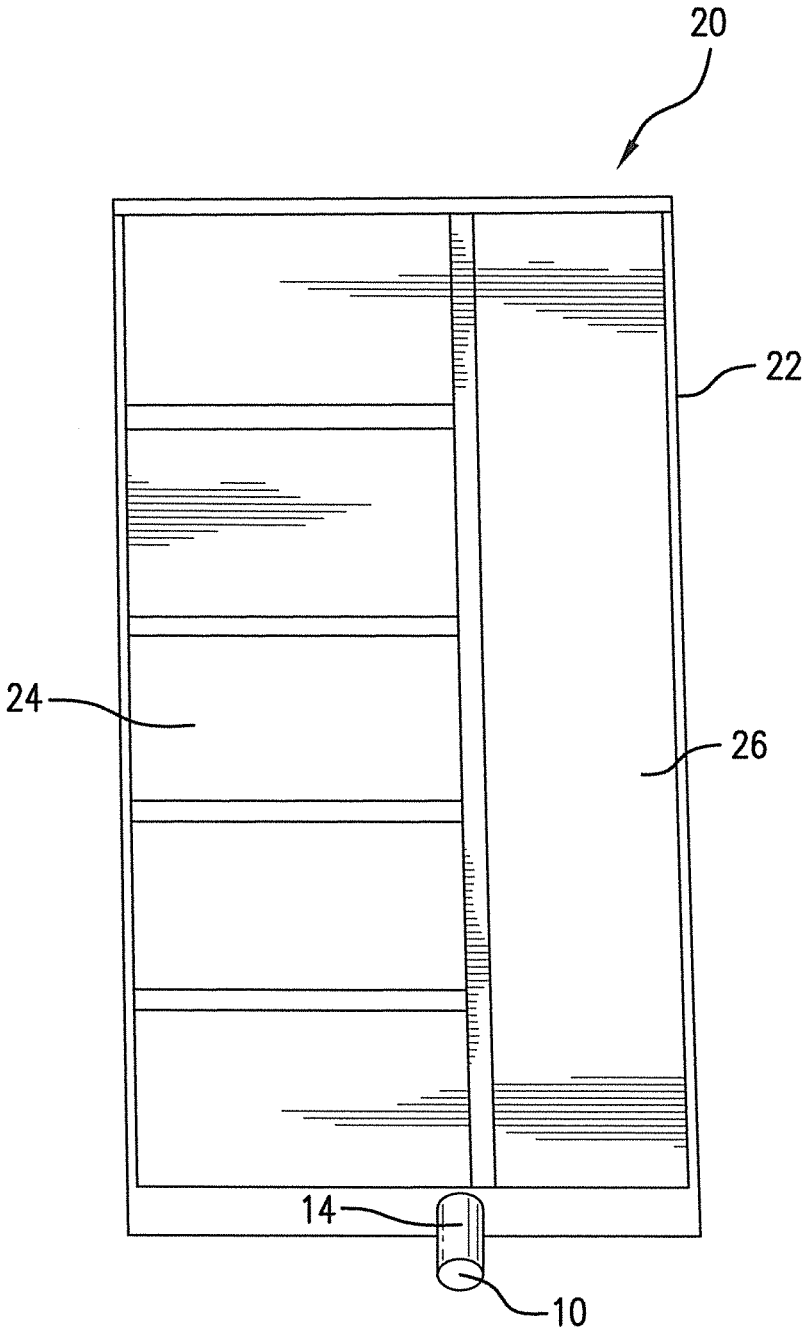
FIG. 1*b* is another front view of the file cabinet of FIG. 1*a* with the outrigger in a deployed position.
Figure 1C:
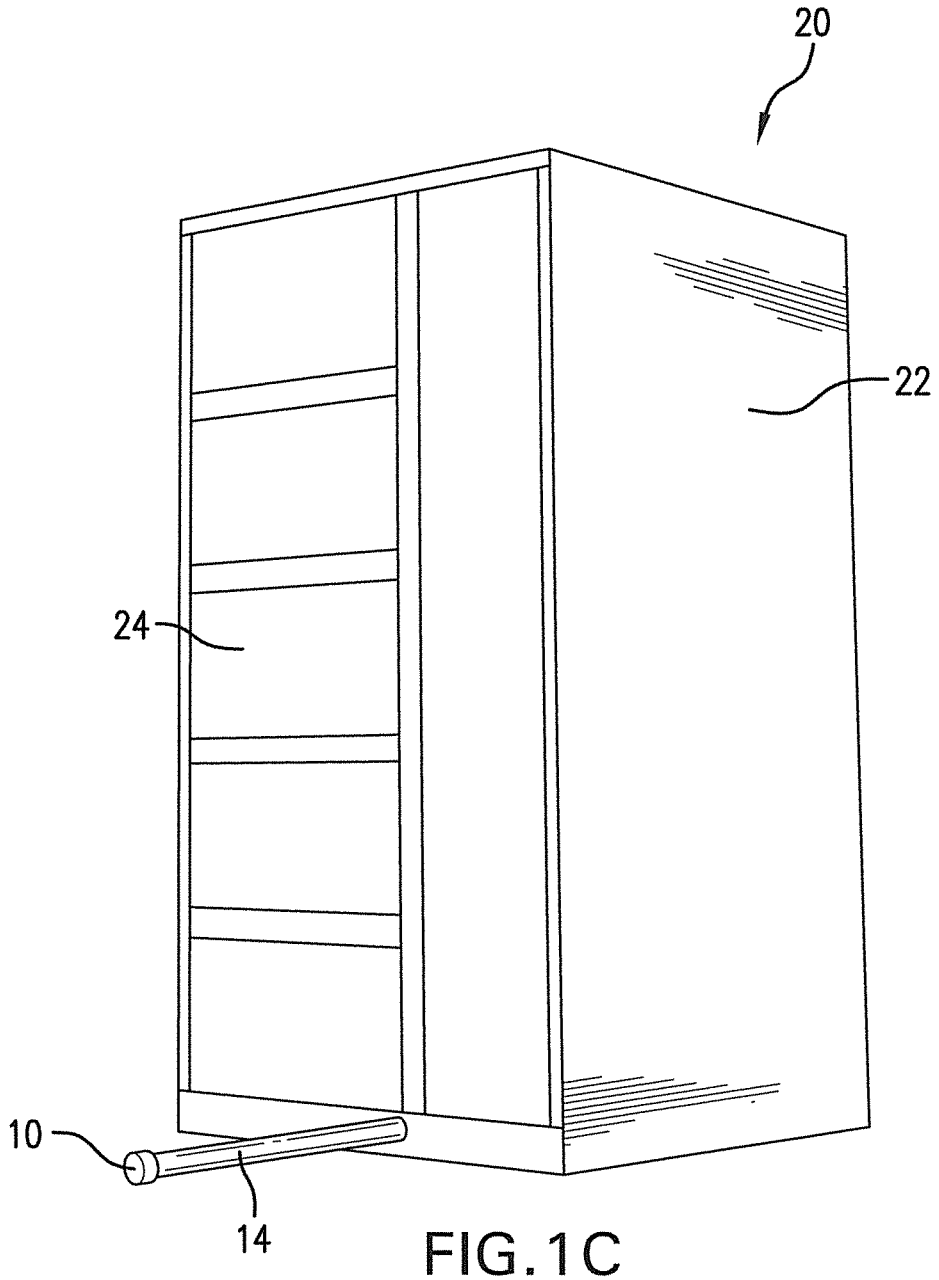
FIG. 1*c* is a perspective view of the file cabinet of FIG. 1*a* with the outrigger in the deployed position.
Figure 1D:
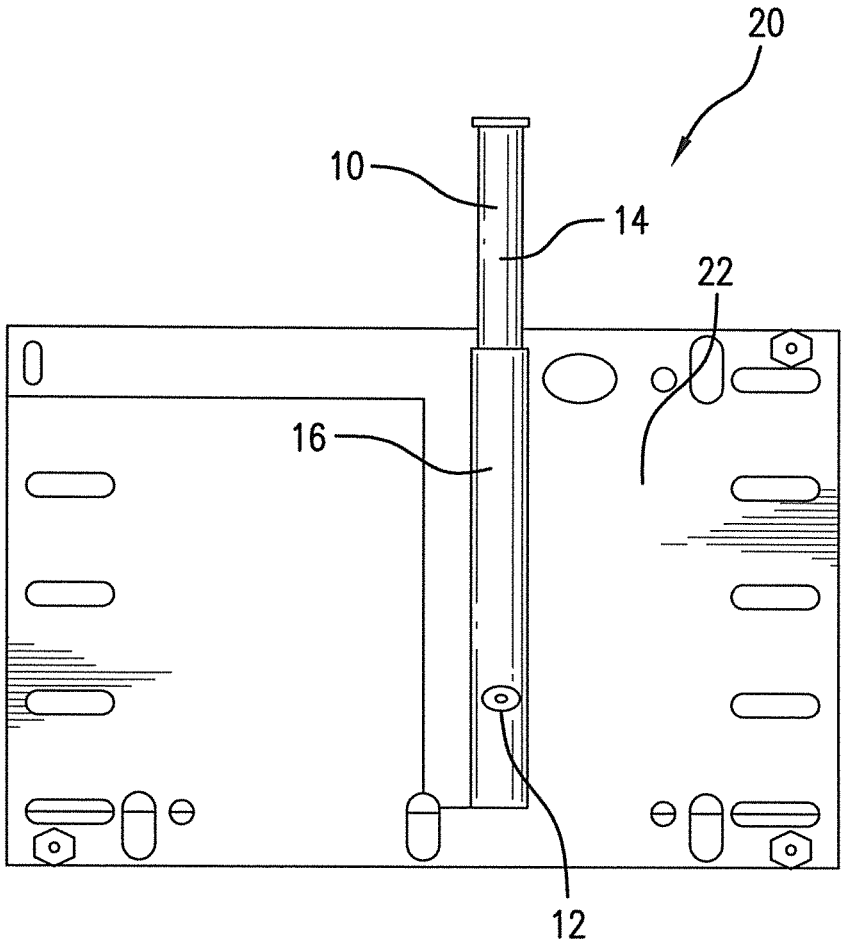
FIG. 1*d* is a bottom side view of the file cabinet of FIG. 1*a* with the outrigger in the deployed position.

FIGS. 1*a-d* show isometric views of an embodiment of the file cabinet 20 of this invention. FIG. 1*a* shows a front view of the file cabinet 20 with the outrigger 10 in a retracted position. FIG. 1*b* shows a front view of the file cabinet 20 with the outrigger 10 in a deployed position. FIG. 1*c* shows a perspective view of the file cabinet 20 in the deployed position. FIG. 1*d* shows a bottom view of the file cabinet 20 with the outrigger 10 in the deployed position. In this embodiment, the file cabinet 20 includes a housing 22 with a plurality of horizontal pull drawers 24 and a wardrobe door 26. Specifically, the file cabinet 20 includes five drawers 24 and one wardrobe door 26. However, the file cabinet 20 may comprise any type of file cabinet having any number of drawers 24 and with or without the wardrobe door 26.

To prevent a freestanding file cabinet from tipping forward and falling over, the retractable outrigger 10 can be deployed to extend outward from the cabinet 20 base as shown in FIGS. 1*b-d*. When deployed, the outrigger 10 enlarges a footprint of the file cabinet 20 to minimize or eliminate a possibility of the file cabinet 20 falling over. In accordance with an embodiment of the invention, the outrigger 10 is maintained in the retracted position with a releasable connection 12. The releasable connection 12 may comprise any of devices including but not limited to: a latch and catch; a plunger and detent; a magnetic device and any other coupling device. The outrigger 10 further includes a cantilever structure 14 that extends from an outrigger base 16 that is bolted, welded or otherwise secured to the housing 22. The cantilever structure 14 may include any cross-sectional shape sufficient to support the weight of the tipped file cabinet 20 including, but not limited to, circular, rectangular, I-beam, and U-shaped. The cantilever structure 14 may be prismatic or tapered. In an alternative embodiment, the cantilever structure may be a lowest drawer in the cabinet. The cantilever structure 14 of the outrigger 10 can be deployed in any way including, but not limited to, a telescoping tube, a roller-track mechanism, and a scissor mechanism. In a preferred embodiment, a force to extend the outrigger 10 may be provided by extension springs, compression springs, gas springs, a pneumatic device, a hydraulic device and electromagnetically. In a preferred embodiment, the outrigger 10 may further include a device to prevent retraction of the cantilever structure 14 after deployment. For example, the device may include, but not limited to, a lock, a dog, and/or a detent. In an embodiment of this invention, the device to prevent retraction may require a manual release to retract the cantilever structure 14. In other embodiments, the device to prevent retraction may not be required as friction will prevent retraction of the cantilever structure. In an embodiment of this invention, an extension limiting stop may be required to prevent the cantilever structure from over-extending.

In operation, according to one embodiment of this invention, the releasable connection 12 extends from a bottom of the housing 22 and contacts the ground under the file cabinet 20 and the outrigger 10. A spring under tension biases the releasable connection 12 against the ground, another portion of the releasable connection 12 prevents the cantilever structure 14 from deploying. Lifting a rear portion of the base of the file cabinet 20 off the ground releases the tension of the spring releasing the releasable connection 12 and in turn the cantilever structure 14. When an angle of a base of the file cabinet 20 and the ground equals a release angle, the releasable connection 12 disengages the cantilever structure 14 allowing the cantilever structure to deploy. In a preferred embodiment, the release angle is significantly less than a balance angle, that is, an angle at which the file cabinet 20 begins to tip and fall over. In other words, the release angle is preferably less than the angle at which a center of gravity of the file cabinet 20 is over the front edge of a footprint of the file cabinet 20. In other embodiments, the release angle may be significantly less than the balance angle. In other embodiments, the release angle may be approximately equal to the balance angle. In embodiments of this invention, the release angle may range from 5° to 30°. However, the release angle of this invention may vary from this range depending on the design of the file cabinet 20 in order to prevent the cabinet from tipping over.

In an embodiment of this invention, the file cabinet 20 may include a plurality of outriggers 10 to prevent the file cabinet from tipping over.

Figure 2A:
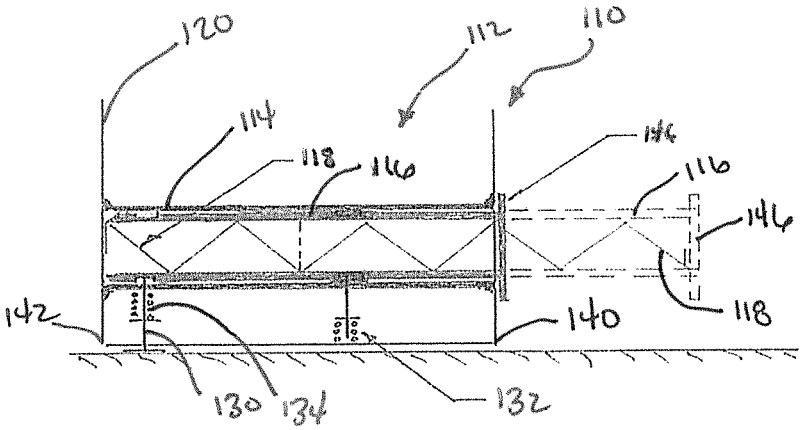
FIG. 2*a* is a schematic view of a file cabinet with an outrigger according to another embodiment of this invention.
Figure 2B:
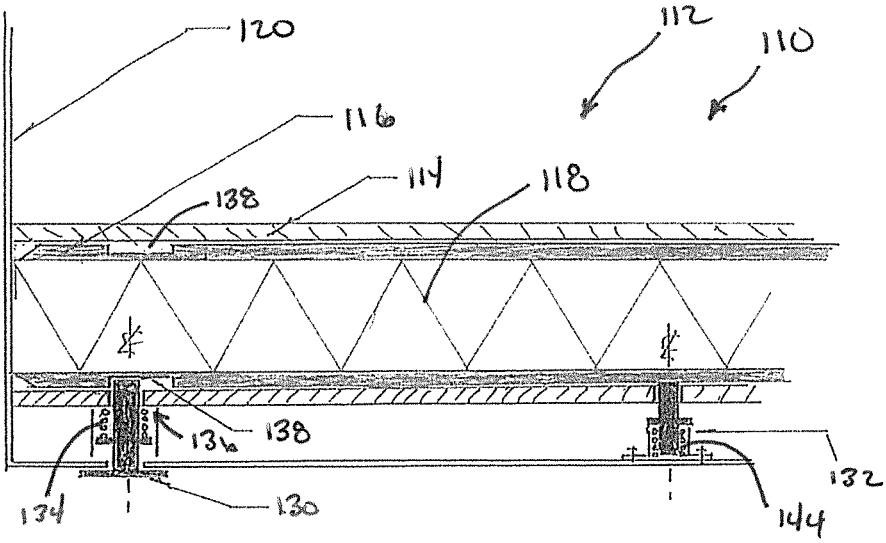
FIG. 2*b* is another schematic view of the file cabinet and outrigger of FIG. 2*a*.
Figure 3A:
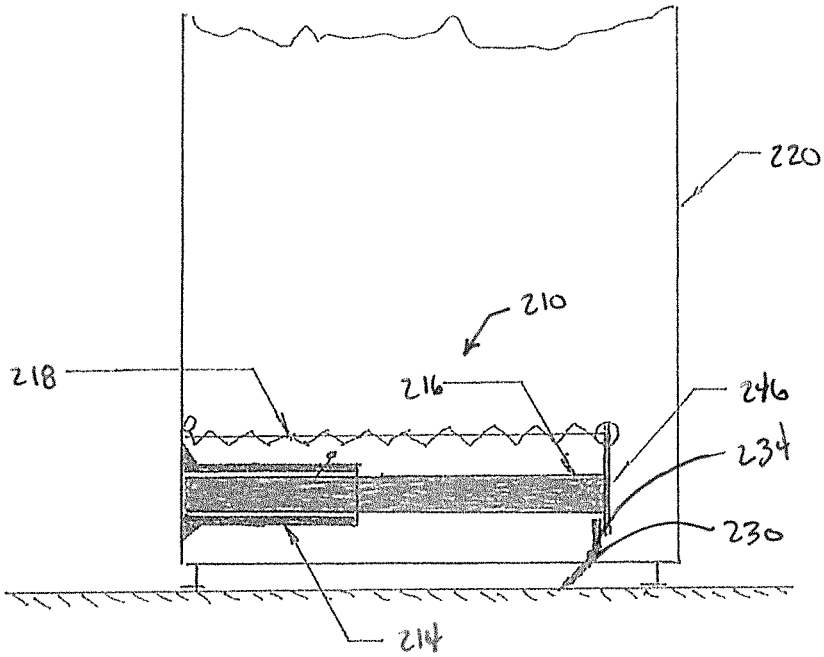
FIG. 3*a* is a schematic view of a file cabinet with an outrigger in a retracted position according to another embodiment of this invention.
Figure 3B:
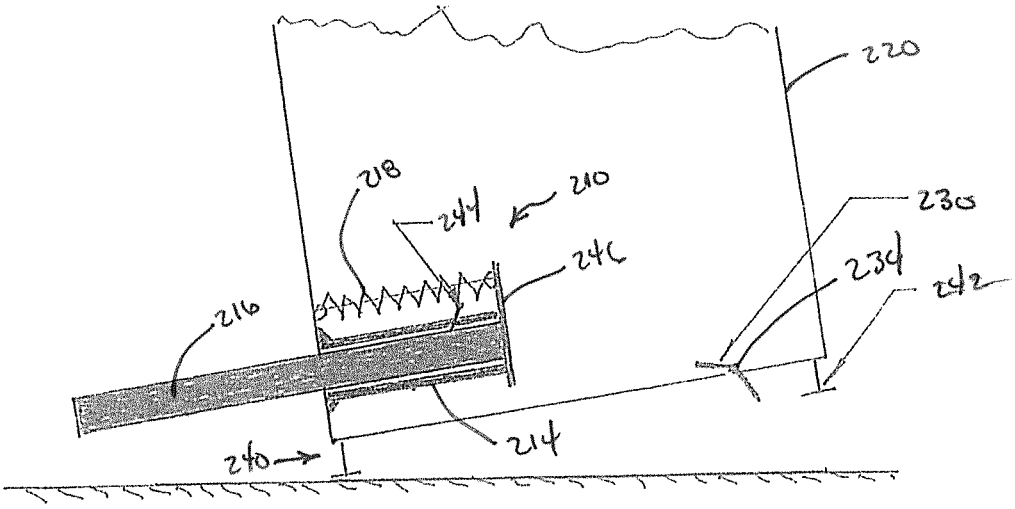
FIG. 3*b* is another schematic view of the file cabinet and outrigger of FIG. 3*a* in a deployed position.

FIGS. 2*a* and 2*b* show a schematic representation of a portion of the file cabinet 120 and the outrigger 110 according to one embodiment of this invention. FIG. 2*a* shows the entire outrigger 110, with the retracted position shown in solid lines and the deployed position shown in broken lines. FIG. 2*b* shows an enlarged portion of the outrigger 110 in the retracted position. The outrigger 110 of this embodiment is an axisymmetric telescoping tube 112 including an outrigger base 114, also known as a sleeve, that is welded or otherwise connected to the cabinet 120. The sleeve 114 surrounds at least a portion of a telescoping tube 116 that operates as the cantilever structure. In this embodiment, the sleeve 114 is a 1¼ inch schedule 40 pipe and the telescoping tube 116 is a 1 inch schedule 40 pipe. However, it should be understood that any type of pipe capable of supporting the cabinet in a leaning state can be used. Alternatively, the telescoping tube 112 may not be a pipe and may comprise any cross-sectional shapes which can be aligned to telescope. The telescoping tube 116 preferably further includes a circular disk 146. The telescoping tube 116 is extended from the retracted position to the deployed position with a spring 118. Alternatively, a gas spring, a pneumatic device, a hydraulic device, an electromechanical device or any other device may be used to extend the telescoping tube 116. As best shown in FIG. 2*b*, the outrigger 110 of this invention includes a plunger 130 for holding the telescoping tube 116 in the retracted position and a stop 132 to hold the telescoping tube 116 in the deployed position. In this embodiment, the plunger 130 includes a plunger spring 134 that biases the plunger 130 from an engaged position to a disengaged position. In the engaged position, the plunger 130 extends through a hole 136 in the sleeve 114 and engages a detent 138, in this embodiment a circumferential detent 138, in the telescoping tube 116. The plunger 130 is held in the circumferential detent 138 via proximity of the file cabinet 120 to the ground. As the file cabinet 120 is tipped on a front edge 140, a rear edge 142 of the file cabinet 120 lifts from the ground allowing the plunger spring 134 to expand, biasing the plunger 130 away from the telescoping tube 116. When an angle between a bottom surface of the file cabinet 120 and the ground equals a release angle, the plunger 130 disengages from the circumferential detent 138 releasing the telescoping tube 116. The spring 118 of the outrigger 110 forces the telescoping tube 116 to the deployed position. A distance the telescoping tube 116 extends from the file cabinet may range from 3 inches to 24 inches or more depending on the weight and size of the file cabinet 120. In a preferred embodiment, the outrigger 110 further includes the stop 132 to prevent the outrigger 110 from over-extending. As shown in FIGS. 3*a* and 3*b*, the stop 132 includes a spring 144 that biases the stop 132 towards the telescoping tube 116. When the detent 138 is aligned with the lock 132, the spring 14 forces the lock 132 into the detent 138, locking the telescoping tube 116 in the deployed position. In this embodiment of this invention, the lock 132 includes a release to disengage the lock 132 from the detent 138 and allow the outrigger 110 to be returned to the retracted position.

FIGS. 3*a* and 3*b* show a schematic representation of a portion of the file cabinet 220 and the outrigger 210 according to another embodiment of this invention. FIG. 3*a* shows the outrigger 210 in the retracted position. FIG. 3*b* shows the outrigger 210 in the deployed position. The outrigger 210 of this embodiment is a rectangular tube outrigger 212. The outrigger 210 includes the outrigger base, specifically a bearing 214 in this embodiment, that is welded or otherwise connected to an interior of the cabinet 220. The bearing 214 surrounds at least a portion of a telescoping tube 216 that operates as the cantilever structure. As shown in FIG. 3*a*, the telescoping tube 216 includes an end plate 246 that engages with a latch 230 to hold the outrigger 210 in the retracted position. The end plate 246 also contacts the bearing 214 in the deployed position to prevent the outrigger from over-extending. In this embodiment, an extension spring 218 extends from the interior of the cabinet 220 to the end plate 246. The spring 218 pulls the telescoping tube 216 from the retracted position to the deployed position when the latch 230 releases the end plate 246. In this embodiment, the latch 230 includes a torsion spring that biases the latch 230 from an engaged position to a disengaged position. In the retracted position shown in FIG. 3*a*, the latch 230 is held in the engaged position and cannot turn due to the proximity of a bottom surface of the cabinet 220 to the ground. In the engaged position, the latch 230 is held against the end plate of telescoping tube 216 holding the outrigger 210 in the retracted position. As the file cabinet 220 is tipped on a front edge 240, a rear edge 242 of the file cabinet 220 lifts from the ground allowing the torsion spring 234 to turn the latch 230. When an angle between a bottom surface of the file cabinet 220 and the ground equals a release angle, the latch 230 disengages from the end plate 246 releasing the telescoping tube 216. The spring 218 of the outrigger 210 forces the telescoping tube 216 to the deployed position, shown in FIG. 3*b*. A distance the telescoping tube 216 extends from the file cabinet 220 may range from 3 inches to 24 inches or more depending on the weight and size of the file cabinet 220. In a preferred embodiment, the outrigger 210 further includes a dog 244 to prevent the outrigger 210 from over-extending. In an embodiment of this invention, the dog 144 includes a release to disengage the dog 244 allow the outrigger 210 to be returned to the retracted position.

Figure 4:
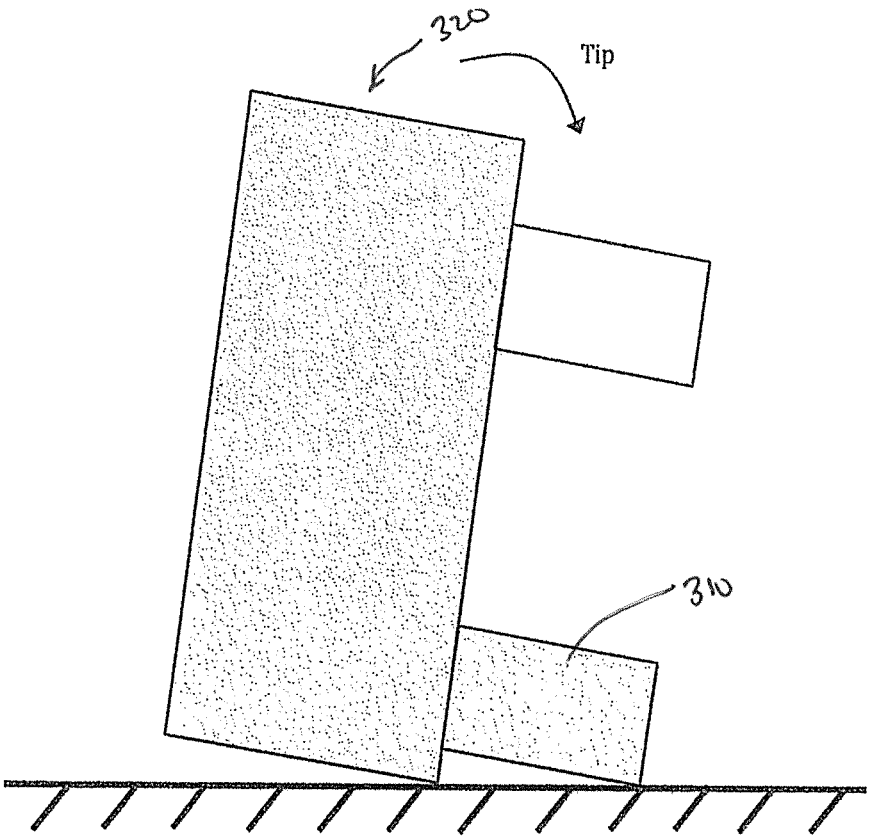
FIG. 4 is a schematic view of a file cabinet with a lower drawer as an outrigger according to another embodiment of this invention.

FIG. 4 shows a schematic representation of a file cabinet 320 according to another embodiment of this invention. In this embodiment, a lowest drawer 310 of the file cabinet 320 operates as an outrigger. The lowest drawer 310 slides on a roller track system. In this embodiment, the lowest drawer 310 is connected to means to force the lowest drawer 310 to extend to a deployed position including, but not limited to, a spring, a gas spring, a pneumatic or hydraulic device and an electromagnetic device. A catch holds the lowest drawer 310 in a retracted position. The catch can release the lowest drawer to allow it to extend into the deployed position. In a preferred embodiment, the lowest drawer 310 must be able to support the weight of the file cabinet 320 plus lading at least for a short period of time to allow a person to avoid the tipping file cabinet 320. In a preferred embodiment, the file cabinet 320 must not include an interlock on the lowest drawer 310 that prevents deployment of the lowest drawer 310.

Figure 5A:
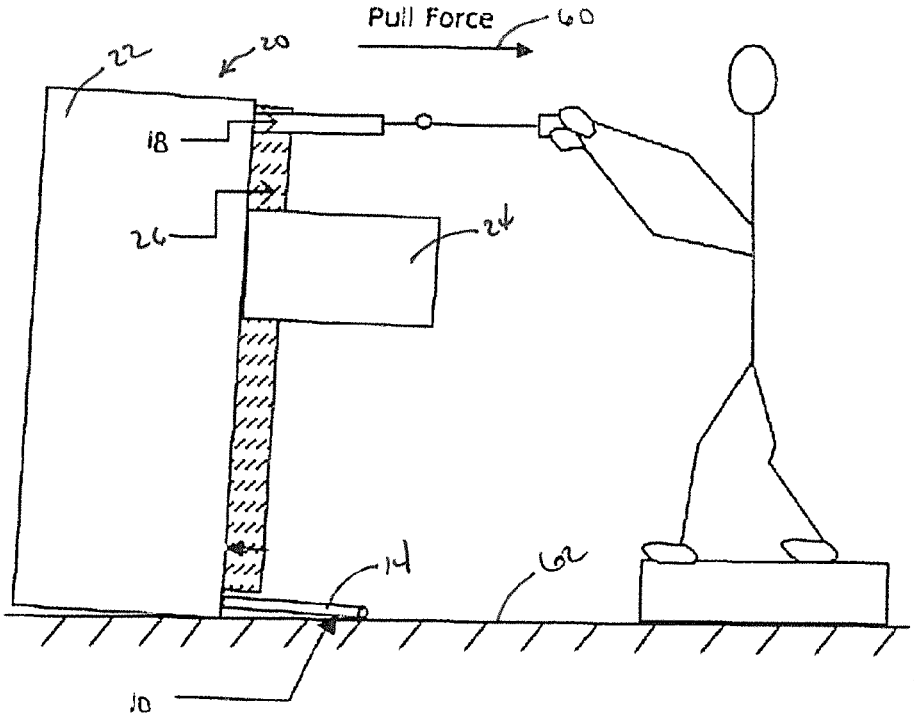
FIG. 5*a* is a schematic view of a test set up for a file cabinet with an outrigger according to an embodiment of this invention.

Experimental Results:

Test 1: Empty Cabinet with Outrigger on a Tile Floor:

FIG. 5*a* shows a schematic representation of an experiment illustrating an embodiment of the file cabinet 20 of this invention. In this experiment, a file cabinet 20 was tested. In FIG. 5*a*, an outrigger 10 was retrofit to the file cabinet 20. The outrigger 10 was designed to extend 14 inches in front of a front surface of the file cabinet 20. The file cabinet was a tower-vertical, 4 drawer cabinet with a lift-up drawer and a wardrobe door, measuring 24 inches by 24 inches by 65.5 inches tall, weighing 189 lbs. without a counterweight. Test conditions included: a level, asphalt tile over a concrete surface 62; the wardrobe door 26 open; a lift-up drawer 18 open and fully extended; the top drawer 24 open and empty; the remaining drawers closed and empty; and a calibrated dynamometer. A tipping force 60 was applied to the cabinet 20 at 64 inches off the ground. The following test data was obtained:

TABLE 1

| Trial No. | Pull Force, to tip |
|---|---|
| 1 | 57.7 lbs. |
| 2 | 57.2 lbs. |
| 3 | 55.9 lbs. |
| 4 | 56.2 lbs. |
| 5 | 54.5 lbs. |

The statistical characterization of the test results provide: an average forward tip resistance of 56.30 lbs.; a standard deviation of 1.24 lbs.; and a coefficient of variation of 2.21%.

Figure 5B:
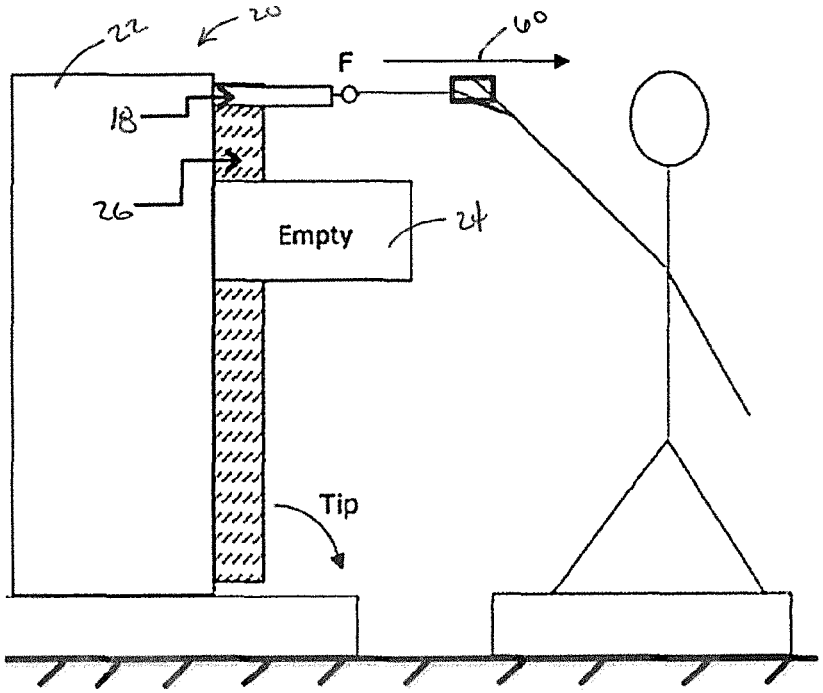
FIG. 5*b* is a schematic view of a test set up for the file cabinet of FIG. 5*a* without the outrigger.

Without the outrigger attached to the cabinet 20, as shown in FIG. 5*b*, the following test data was obtained:

TABLE 2

| Trial No. | Pull Force, to tip |
|---|---|
| 1 | 18.3 lbs. |
| 2 | 18.0 lbs. |
| 3 | 19.5 lbs. |
| 4 | 18.5 lbs. |
| 5 | 18.9 lbs. |
| 6 | 18.8 lbs. |
| 7 | 18.5 lbs. |
| 8 | 19.1 lbs. |
| 9 | 19.0 lbs. |
| 10 | 18.6 lbs. |

The statistical characterization of the test results provide: an average forward tip resistance of 18.72 lbs.; a standard deviation of 0.432 lbs.; a coefficient of variation of 2.3% and a balance angle of 15.5°.

From these results, it is shown that the outrigger 10 of this invention provides significant improvement in the forward tip resistance.

Figure 6A:
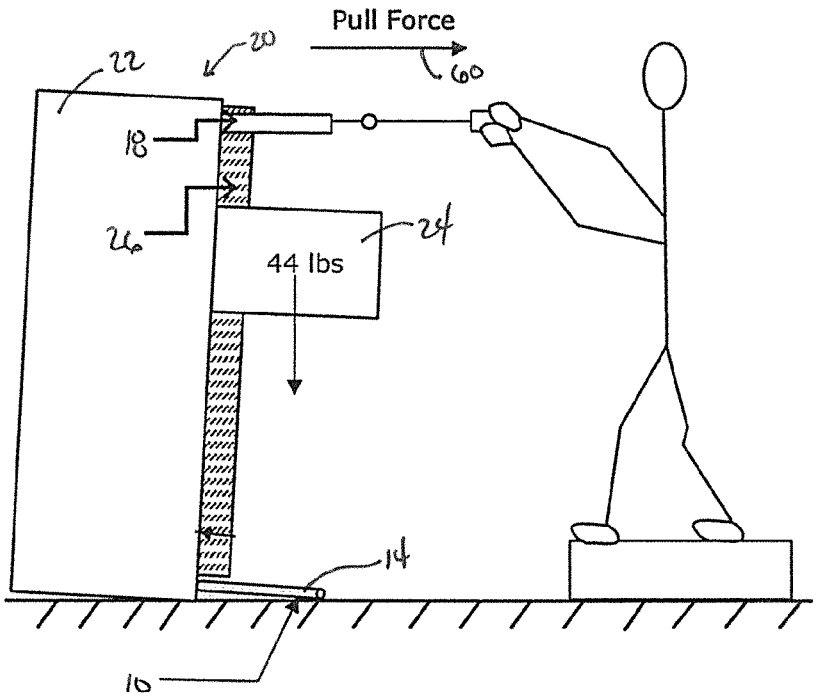
FIG. 6*a* is a schematic view of a test set up for a file cabinet with an outrigger according to an embodiment of this invention.
Figure 6B:
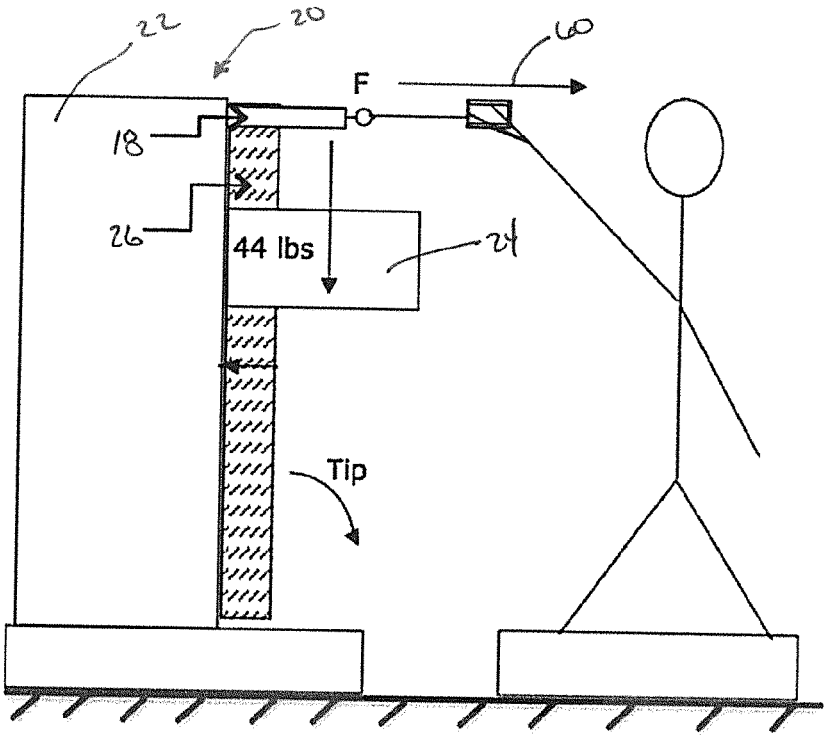
FIG. 6*b* is a schematic view of a test set up for the file cabinet of FIG. 6*a* without the outrigger.

Test 2: Loaded Drawer with Outrigger on a Tile Floor:

FIGS. 6*a*-*b*, show a schematic representation of an experiment illustrating an embodiment of the file cabinet 20 of this invention. In this experiment, the same cabinet in Test 1 was tested with the same test conditions except the top drawer was open and loaded with 44 lbs. centered 10 inches from the housing of the file cabinet 20. A pull force 60 was applied to the cabinet 20 at 64 inches off the ground. The following test data was obtained:

TABLE 3

| Trial No. | Pull Force, to tip |
|---|---|
| 1 | 48.0 lbs. |
| 2 | 44.9 lbs. |
| 3 | 49.0 lbs. |
| 4 | 47.8 lbs. |
| 5 | 48.2 lbs. |

The statistical characterization of the test results provide: an average forward tip resistance of 47.58 lbs.; a standard deviation of 1.57 lbs.; and a coefficient of variation of 3.29%.

Without the outrigger attached to the cabinet 20, as shown in FIG. 6*b*, the following test data was obtained:

TABLE 4

| Trial No. | Pull Force, to tip |
|---|---|
| 1 | 9.1 lbs. |
| 2 | 9.0 lbs. |
| 3 | 9.2 lbs. |
| 4 | 9.3 lbs. |
| 5 | 9.7 lbs. |
| 6 | 9.5 lbs. |
| 7 | 9.7 lbs. |
| 8 | 9.6 lbs. |
| 9 | 9.7 lbs. |
| 10 | 9.1 lbs. |

The statistical characterization of the test results provide: an average forward tip resistance of 9.39 lbs.; a standard deviation of 0.281 lbs.; a coefficient of variation of 2.99% and a balance angle of 9.0°.

From these results, it is shown that the outrigger 10 of this invention provides significant improvement in the forward tip resistance.

Test 3: Empty Cabinet with Outrigger on a Carpeted Floor:

In this experiment, the same cabinet in Test 1 was tested with the same test conditions except the surface was a carpeted surface. FIG. 5*a* shows a schematic representation of the experiment. A tipping force 14 was applied to the cabinet 20 at 64 inches off the ground. The following test data was obtained:

TABLE 5

| Trial No. | Pull Force, to tip |
|---|---|
| 1 | 53.8 lbs. |
| 2 | 54.3 lbs. |
| 3 | 53.6 lbs. |
| 4 | 59.7 lbs. |
| 5 | 51.8 lbs. |

The statistical characterization of the test results provide: an average forward tip resistance of 54.64 lbs.; a standard deviation of 2.98 lbs.; and a coefficient of variation of 5.46%.

Without the outrigger attached to the cabinet 20, as shown in FIG. 5*b*, the following test data was obtained:

TABLE 6

| Trial No. | Pull Force, to tip |
|---|---|
| 1 | 18.3 lbs. |
| 2 | 18.0 lbs. |
| 3 | 19.5 lbs. |

TABLE 6-continued

| Trial No. | Pull Force, to tip |
|---|---|
| 4 | 18.5 lbs. |
| 5 | 18.9 lbs. |
| 6 | 18.8 lbs. |
| 7 | 18.5 lbs. |
| 8 | 19.1 lbs. |
| 9 | 19.0 lbs. |
| 10 | 18.6 lbs. |

The statistical characterization of the test results provide: an average forward tip resistance of 18.72 lbs.; a standard deviation of 0.432 lbs.; a coefficient of variation of 2.3% and a balance angle of 15.5°.

From these results, it is shown that the outrigger 10 of this invention provides significant improvement in the forward tip resistance.

Test 4: Loaded Drawer with Outrigger on a Carpeted Floor:

In this experiment, the same cabinet in Test 3 was tested with the same test conditions except the top drawer was open and loaded with 44 lbs. centered 10 inches from the housing of the file cabinet 20. FIGS. 6*a-b*, show a schematic representation of the experiment. A tipping force 14 was applied to the cabinet 20 at 64 inches off the ground. The following test data was obtained:

TABLE 7

| Trial No. | Pull Force, to tip |
|---|---|
| 1 | 46.8 lbs. |
| 2 | 45.8 lbs. |
| 3 | 46.8 lbs. |
| 4 | 46.3 lbs. |
| 5 | 48.3 lbs. |

The statistical characterization of the test results provide: an average forward tip resistance of 46.80 lbs.; a standard deviation of 0.935 lbs.; and a coefficient of variation of 2.00%.

Without the outrigger attached to the cabinet 20, as shown in FIG. 6*b*, the following test data was obtained:

TABLE 4

| Trial No. | Pull Force, to tip |
|---|---|
| 1 | 9.1 lbs. |
| 2 | 9.0 lbs. |
| 3 | 9.2 lbs. |
| 4 | 9.3 lbs. |
| 5 | 9.7 lbs. |
| 6 | 9.5 lbs. |
| 7 | 9.7 lbs. |
| 8 | 9.6 lbs. |
| 9 | 9.7 lbs. |
| 10 | 9.1 lbs. |

The statistical characterization of the test results provide: an average forward tip resistance of 9.39 lbs.; a standard deviation of 0.281 lbs.; a coefficient of variation of 2.99% and a balance angle of 9.0°.

From these results, it is shown that the outrigger 10 of this invention provides significant improvement in the forward tip resistance.

Thus, the present invention provides an improved file cabinet with an outrigger to prevent the cabinet from tipping over and possibly causing injuries.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A tip resistant file cabinet comprising:

a housing including a vertical front surface and a drawer; and an outrigger positioned in proximity to a bottom of the housing, the outrigger including a outrigger base and a cantilever structure, the outrigger including a bias element to move the cantilever structure from a retracted position to a deployed position beyond the vertical front surface; and a releasable connection in contact with the cantilever structure to hold the cantilever structure in the retracted position, wherein the releasable connection automatically releases the cantilever structure and the bias element automatically moves the cantilever structure to the deployed position when the file cabinet tips to a release angle.

2. The tip resistant file cabinet of claim 1, wherein the bias element comprises one of an extension spring, a compression spring, a gas spring, a pneumatic device, a hydraulic device and an electromagnetic device.

3. The tip resistant file cabinet of claim 1, wherein the releasable connection comprises one of a latch and catch device, a plunger and detent, and a magnetic device.

4. The tip resistant file cabinet of claim 1, wherein the outrigger comprises one of an axisymmetric telescoping tube, a roller-track mechanism, and a scissor mechanism.

5. The tip resistant file cabinet of claim 1, wherein the outrigger comprises a lowest drawer of the file cabinet.

6. The tip resistant file cabinet of claim 1, further including at least one of a lock, a dog and a detent to prevent retraction of the cantilever structure when the outrigger is in the deployed position.

7. The tip resistant file cabinet of claim 1, further including a leveling screw connected to a base of the housing.

8. A tip resistant file cabinet comprising:

a housing including a vertical front surface and a drawer; and an outrigger positioned in proximity to a bottom of the housing and at an angle to the vertical front surface, the outrigger including a sleeve connection to an interior of the housing and a telescoping tube, the telescoping tube positioned coaxially and at least partially within the sleeve;

a bias element to move the telescoping tube out beyond the vertical front surface from a retracted position to a deployed position; and a releasable connection in contact with the telescoping tube to hold the telescoping tube in the retracted position, wherein the releasable connection automatically releases the telescoping tube and the bias element automatically moves the telescoping tube in a direction toward and beyond the vertical front surface to the deployed position when the file cabinet is tipped to a release angle.

9. The tip resistant file cabinet of claim 8, wherein the bias element comprises one of a one of an extension spring, a compression spring, a gas spring, a pneumatic device, a hydraulic device and an electromagnetic device.

10. The tip resistant file cabinet of claim 8, wherein the releasable connection comprises a plunger that engages a detent in the telescoping tube in the retracted position.

11. The tip resistant file cabinet of claim 10, further including a lock to engage the detent of the telescoping tube in the deployed position.

12. The tip resistant file cabinet of claim 8, further including a leveling screw connected to a base of the housing.

13. A tip resistant file cabinet comprising:

a housing including a vertical front surface and a drawer; and an outrigger positioned in proximity to a bottom of the housing, the outrigger including a bearing connected to an interior of the housing and a telescoping tube, the telescoping tube including an end plate, the telescoping tube positioned at least partially within the bearing and perpendicular to the vertical front surface;

a bias element to move the telescoping tube from a retracted position to a deployed position; and a latch in contact with the end plate of the telescoping tube to hold the telescoping tube in the retracted position, wherein the latch automatically releases the telescoping tube and the bias element automatically moves the telescoping tube to the deployed position when the file cabinet is tipped to a release angle.

14. The tip resistant file cabinet of claim 13, wherein the bias element comprises one of a one of an extension spring, a compression spring, a gas spring, a pneumatic device, a hydraulic device and an electromagnetic device.

15. The tip resistant file cabinet of claim 13, further including a dog to prevent the telescoping tube from over-extending.

16. The tip resistant file cabinet of claim 13, further including a leveling screw connected to a base of the housing.

* * * * *